US007997011B2

(12) United States Patent
Smith et al.

(10) Patent No.: US 7,997,011 B2
(45) Date of Patent: Aug. 16, 2011

(54) FOOTWEAR WITH SUPPORT ASSEMBLY HAVING SPRING ARMS

(75) Inventors: Steven F Smith, Beaverton, OR (US); Christopher Cook, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 878 days.

(21) Appl. No.: 11/538,164

(22) Filed: Oct. 3, 2006

(65) Prior Publication Data

US 2008/0078101 A1 Apr. 3, 2008

(51) Int. Cl.
*A43B 13/18* (2006.01)
*A43B 5/00* (2006.01)

(52) U.S. Cl. ..... 36/28; 36/35 R; 36/37; 36/114; 36/27

(58) Field of Classification Search ..... 36/27, 28, 36/35 R, 37, 42, 114
See application file for complete search history.

(56) References Cited

U.S. PATENT DOCUMENTS

| | | | | |
|---|---|---|---|---|
| 5,279,051 | A | 1/1994 | Whatley | |
| 5,337,492 | A * | 8/1994 | Anderie et al. | 36/28 |
| 5,649,374 | A * | 7/1997 | Chou | 36/27 |
| 5,937,545 | A | 8/1999 | Dyer et al. | |
| 6,487,796 | B1 * | 12/2002 | Avar et al. | 36/28 |
| 6,568,102 | B1 * | 5/2003 | Healy et al. | 36/28 |
| 6,665,958 | B2 * | 12/2003 | Goodwin | 36/29 |
| 7,086,179 | B2 * | 8/2006 | Dojan et al. | 36/29 |
| 7,418,790 | B2 | 9/2008 | Kerrigan | |
| 2003/0051373 | A1 | 3/2003 | Goodwin | |
| 2006/0064900 | A1 * | 3/2006 | Aveni | 36/28 |
| 2006/0179683 | A1 * | 8/2006 | Weiss et al. | 36/28 |
| 2009/0013556 | A1 | 1/2009 | Nishiwaki et al. | |

FOREIGN PATENT DOCUMENTS

| | | | |
|---|---|---|---|
| CN | 101141894 | A | 3/2008 |
| EP | 1844673 | A1 | 10/2007 |
| WO | 2006088441 | A1 | 8/2006 |
| WO | 2006098715 | A | 9/2006 |

OTHER PUBLICATIONS

Search Report/PCT/US2007/079824 dated Sep. 28, 2007.
International Preliminary Report on Patentability mailed Apr. 16, 2009, in corresponding PCT Application No. PCT/US2007/079824.
Office Action issued Dec. 30, 2010 in related Chinese Patent Application No. 200780037166.9 and English translation thereof.

* cited by examiner

*Primary Examiner* — Jila Mohandesi
(74) *Attorney, Agent, or Firm* — Banner & Witcoff, Ltd.

(57) ABSTRACT

An article of footwear includes an upper and a sole assembly secured to the upper and having a support assembly. The support assembly has an upper plate and a lower plate spaced from the upper plate. The lower plate has a peripheral edge and a plurality of spring arms, with each spring arm curving initially outwardly and then upwardly and inwardly from the peripheral edge to the upper plate.

27 Claims, 4 Drawing Sheets

FOOTWEAR WITH SUPPORT ASSEMBLY HAVING SPRING ARMS

FIELD OF THE INVENTION

This invention relates generally to footwear, and, in particular, to an article of footwear with a support assembly having spring arms.

BACKGROUND OF THE INVENTION

Conventional articles of athletic footwear include two primary elements, an upper and a sole assembly. The upper provides a covering for the foot that comfortably receives and securely positions the foot with respect to the sole assembly. In addition, the upper may have a configuration that protects the foot and provides ventilation, thereby cooling the foot and removing perspiration. The sole assembly is secured to a lower portion of the upper and is generally positioned between the foot and the ground. In addition to attenuating ground reaction forces, the sole assembly may provide traction, control foot motions (e.g., by resisting over pronation), and impart stability, for example. Accordingly, the upper and the sole assembly operate cooperatively to provide a comfortable structure that is suited for a wide variety of activities, such as walking and running.

The sole assembly generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole assembly and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a support assembly having spring arms. In accordance with a first aspect, an article of footwear includes an upper and a sole assembly secured to the upper and having a support assembly. The support assembly has an upper plate and a lower plate spaced from the upper plate. The lower plate has a peripheral edge and a plurality of spring arms, with each spring arm curving initially outwardly and then upwardly and inwardly from the peripheral edge to the upper plate.

In accordance with another aspect, an article of footwear includes an upper and a sole assembly secured to the upper. The sole assembly includes a support assembly, which includes an upper plate having a plurality of recesses in a lower surface thereof. A lower plate is spaced from the upper plate and has a peripheral edge. A plurality of spring arms is of unitary construction with the lower plate, with each spring arm curving initially outwardly and upwardly and then inwardly and upwardly from the peripheral edge to the upper plate. Each spring arm includes a flange member at an upper end thereof, with each flange member being received in a recess in the upper plate.

In accordance with a further aspect, an article of footwear includes an upper and a sole assembly secured to the upper. The sole assembly includes a midsole and a support assembly positioned beneath a heel portion of the midsole. The support assembly includes an upper plate including four recesses in a lower surface thereof and a lower plate spaced from the upper plate and having a peripheral edge. Four spring arms are positioned about a peripheral edge of the lower plate and are of unitary construction with the lower plate. Each spring arm curves initially outwardly and upwardly and then inwardly and upwardly from the peripheral edge to the upper plate and is completely curvilinear between the upper plate and the lower plate. Each spring arm includes a flange member at an upper end thereof, with each flange member being received in a recess in the upper plate. An outsole includes a plurality of outsole elements, with an outsole element being positioned beneath each spring arm.

Substantial advantage is achieved by providing an article of footwear with a support assembly having spring arms. In particular, certain embodiments provide improved support and cushioning for the user.

These and additional features and advantages disclosed here will be further understood from the following detailed disclosure of certain embodiments.

Figure 1:
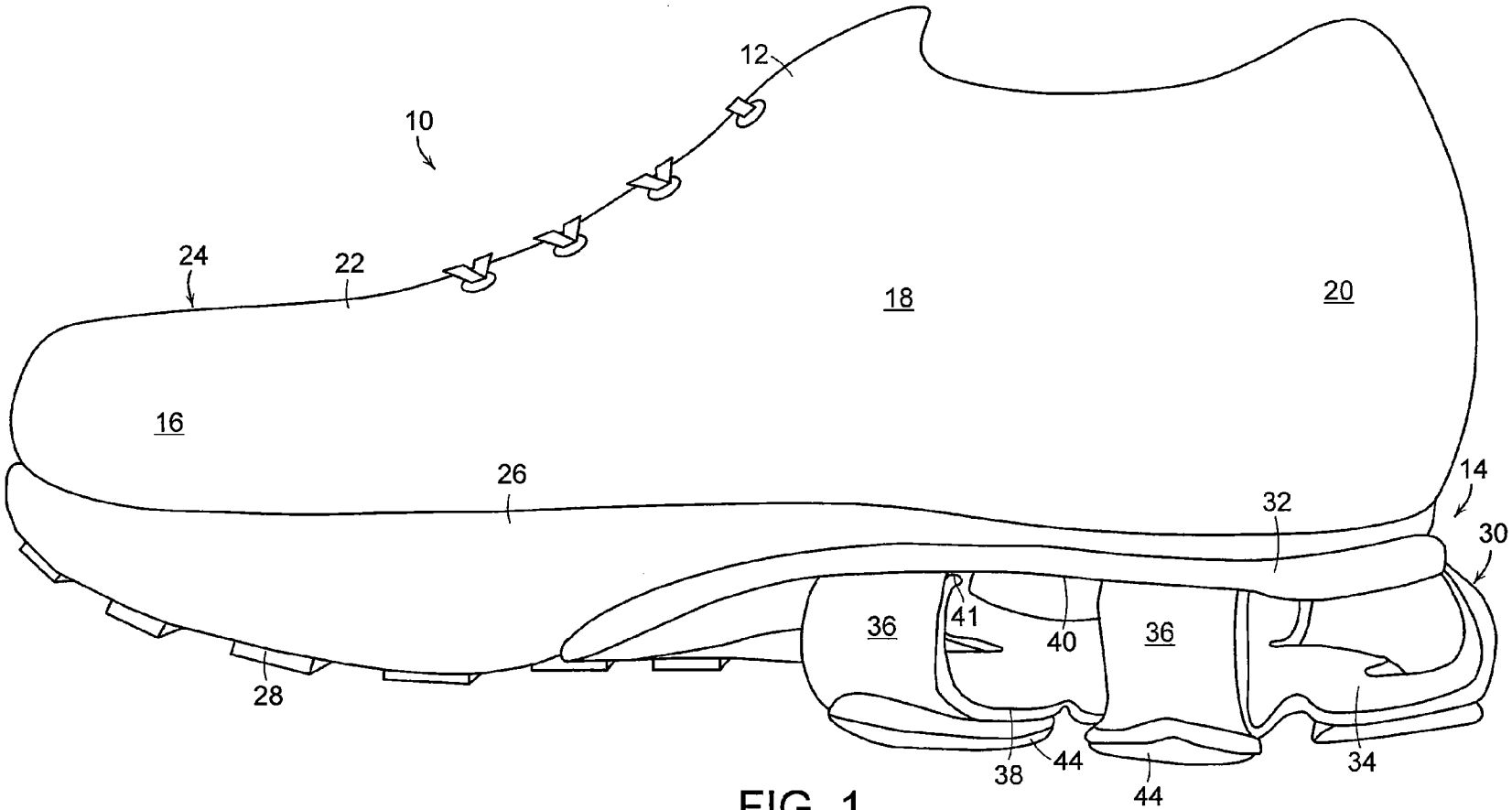
FIG. 1 is a perspective view of an article of footwear with a support assembly having a plurality of spring arms.

The figures referred to above are not drawn necessarily to scale and should be understood to provide a representation of the invention, illustrative of the principles involved. Some features of the article of footwear with a support assembly having spring arms depicted in the drawings have been enlarged or distorted relative to others to facilitate explanation and understanding. The same reference numbers are used in the drawings for similar or identical components and features shown in various alternative embodiments. Articles of footwear with a support assembly having spring arms as disclosed herein would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with aspects of the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles, including dress shoes, loafers, sandals, and work boots. Accordingly, one skilled in the relevant art will recognize that the concepts disclosed herein may be applied to a wide range of footwear styles and are not limited to the specific embodiments discussed below and depicted in the figures.

Figure 2:
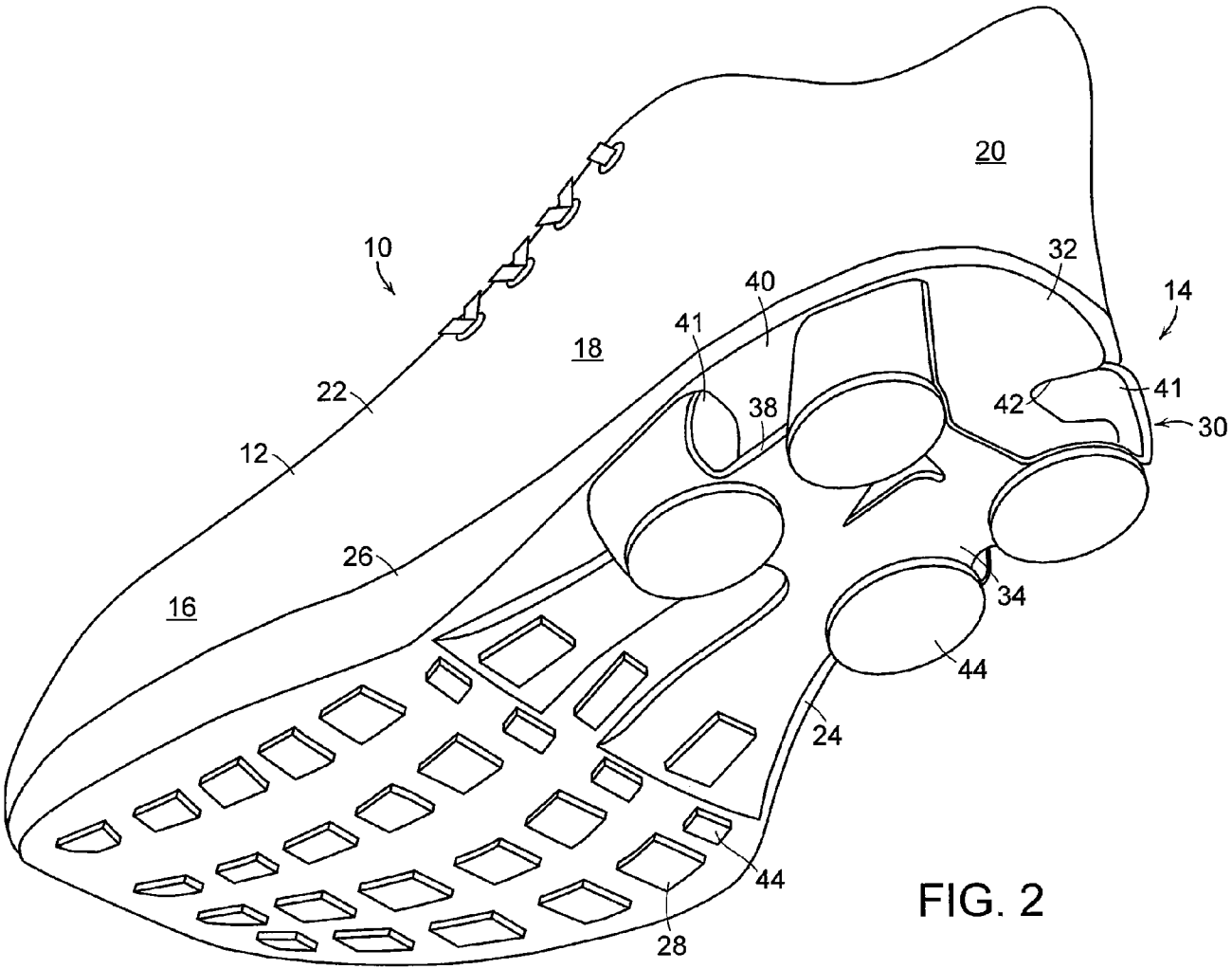
FIG. 2 is a perspective view showing the bottom and medial side of the article of footwear of FIG. 1.
Figure 3:
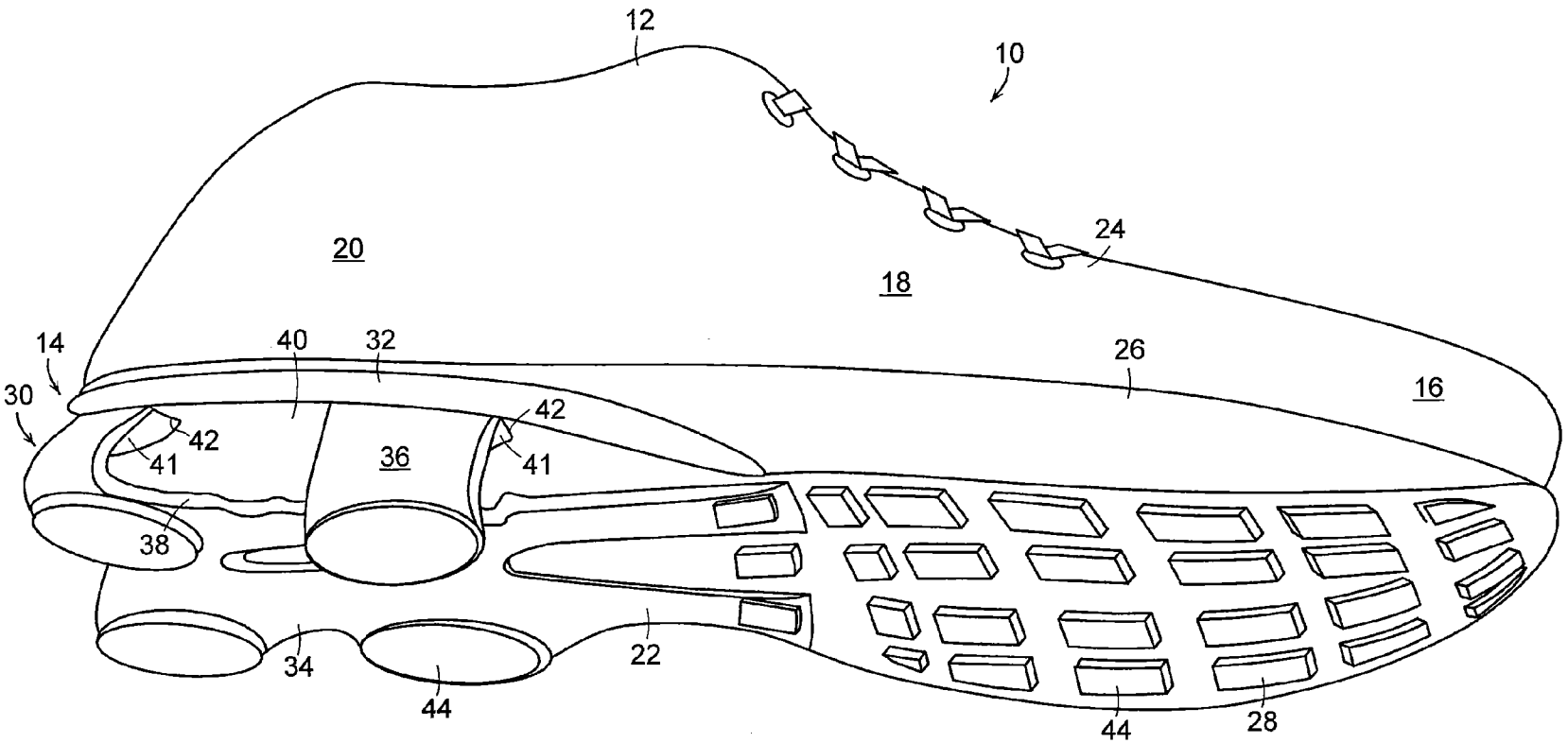
FIG. 3 is a perspective view showing the bottom and lateral side of the article of footwear of FIG. 1.

Footwear 10 is depicted in FIGS. 1-3 and includes an upper 12 and a sole assembly 14. For purposes of reference, footwear 10 may be divided into three general regions: a forefoot region 16, a midfoot region 18, and a heel region 20, as defined in FIG. 1. Forefoot region 16 generally includes portions of footwear 10 corresponding with the toes and the joints connecting the metatarsals with the phalanges. Midfoot region 18 generally includes portions of footwear 10 corresponding with the arch area of the foot, and heel region 20 corresponds with rear portions of the foot, including the calcaneus bone. Footwear 10 also includes a medial side 22 and an opposite lateral side 24. Medial side 22 and lateral side 24 extend through each of regions 16-20 and correspond with opposite sides of footwear 10.

Regions 16-20 and sides 22-24 are not intended to demarcate precise areas of footwear 10. Rather, regions 16-20 and sides 22-24 are intended to represent general areas of footwear 10 that provide a frame of reference during the following discussion. Although regions 16-20 and sides 22-24 apply generally to footwear 10, references to regions 16-20 and sides 22-24 may also apply specifically to upper 12, sole assembly 14, or an individual component or portion within either of upper 12 or sole assembly 14, or any other component of footwear 10.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 is formed from various material elements that are stitched or adhesively-bonded together to form an interior void that comfortably receives a foot and secures the position of the foot relative to sole assembly 14. A variety of materials are suitable for upper 12, including the materials that are conventionally utilized in footwear uppers. Accordingly, upper 12 may be formed from combinations of leather, synthetic leather, natural or synthetic textiles, polymer sheets, polymer foams, mesh textiles, felts, non-woven polymers, or rubber materials, for example. The interior of upper 12 may have foam elements for enhancing the comfort of footwear 10, and the interior surface may include a moisture-wicking textile for removing excess moisture from the area immediately surrounding the foot.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is attached to upper 22 and functions as the primary shock-attenuating and energy-absorbing component of footwear 10. Suitable materials for midsole 26 are any of the conventional polymer foams that are utilized in footwear midsoles, including ethylvinylacetate and polyurethane foam.

Outsole 28 is secured to a lower surface of midsole 26 to provide wear-resistance. In addition, outsole 28 may be textured to enhance the traction (e.g., friction) properties between footwear 10 and the ground. Suitable materials for outsole 28 include any of the conventional rubber materials that are utilized in footwear outsoles, such as carbon black rubber compound. Other suitable materials for outsole 28 will become readily apparent to those skilled in the art, given the benefit of this disclosure.

Sole assembly 14 includes a support assembly 30 having an upper plate 32 and a lower plate 34 spaced from upper plate 32. In certain embodiments, upper plate 32 is formed of polymers, e.g., polyether-block co-polyamide polymers (sold as Pebax® by ATOFINA Chemicals of Philadelphia, Pa.). Upper plate 32 may also be formed of nylon, thermoplastic polyurethane (TPU), a carbon fiber composite, a glass fiber composite, or a blend of acrylonitrile butadiene styrene (ABS) and TPU. Other suitable materials for upper plate 32 will become readily apparent to those skilled in the art, given the benefit of this disclosure.

In certain embodiments, lower plate 34 is formed of nylon. Lower plate 34 may also be formed of a carbon fiber composite, a glass fiber composite, TPU, a nylon/TPU blend, a polyether-block co-polyamide polymer, or an ABS/TPU blend. Other suitable materials for lower plate 34 will become readily apparent to those skilled in the art, given the benefit of this disclosure.

Figure 4:
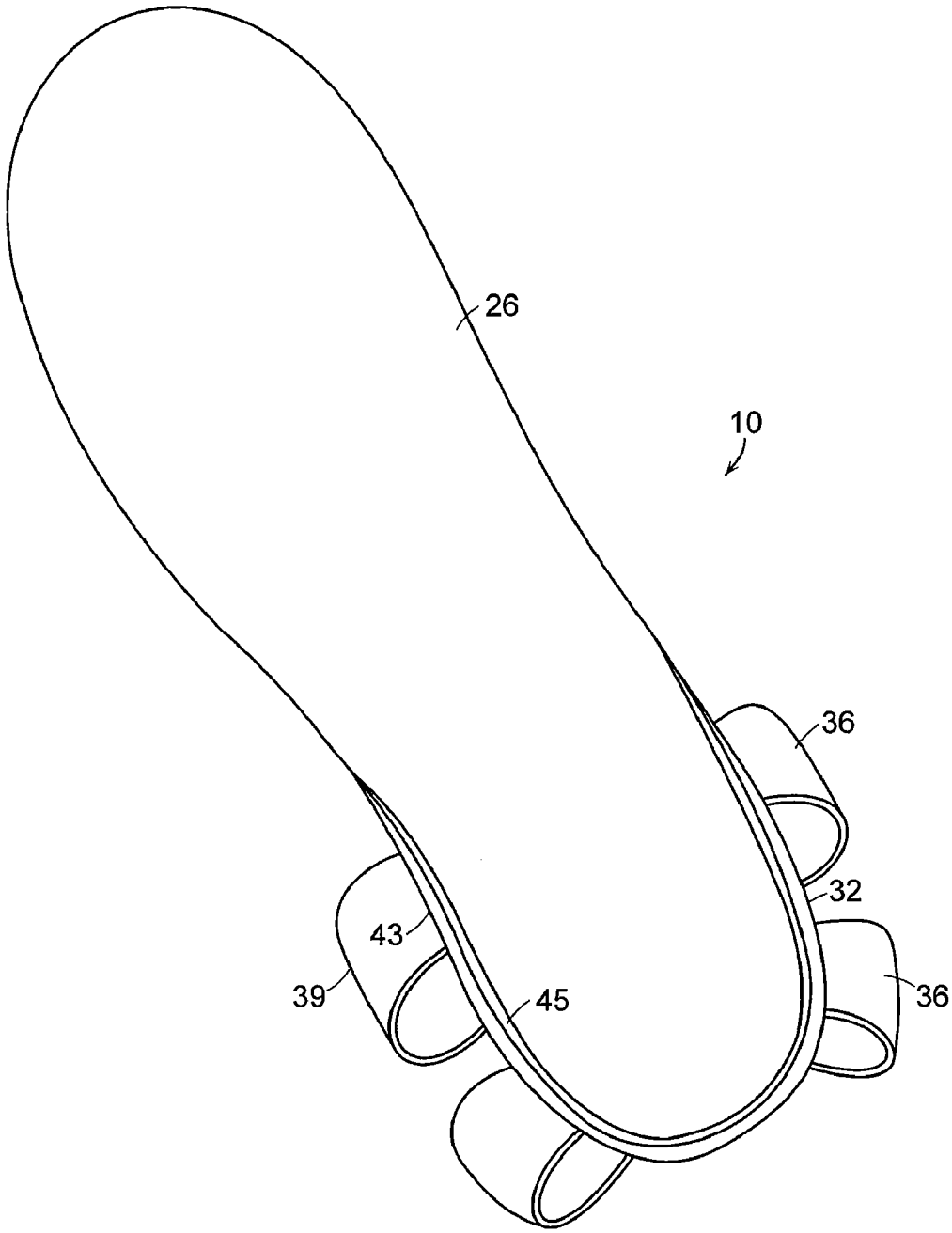
FIG. 4 is a perspective view from above of a portion of the article of footwear of FIG. 1, showing the upper plate and spring arms of the support assembly positioned beneath the midsole.

Lower plate 34 includes a plurality of spring arms 36. Spring arms 36 are positioned about a peripheral edge 38 of lower plate 34. Spring arms 36 curve initially outwardly and upwardly and then inwardly and upwardly from peripheral edge 38 of lower plate 34 to a lower surface 40 of upper plate 32. As seen in FIG. 4, each spring arm 36 curves outwardly to an extent that an outermost peripheral edge 39 of spring arm 36 is positioned outwardly of a peripheral edge 43 of upper plate 32 and a peripheral edge 45 of midsole 26.

A flange member 41 may be formed at the upper end of each spring arm 36 and extend inwardly under upper plate 32. In certain embodiments, flange members 41 are of unitary construction with their corresponding spring arm 36. A plurality of recesses 42 is formed in the lower surface of upper plate 32, with a flange member 41 being received in each recess 42.

An upper surface of each flange member 41 is secured to a lower surface of upper plate 32 within a corresponding recess 42. Flange members 41 may be secured to upper plate 32 with adhesive or other suitable fastening means. Suitable alternative fastening means for securing spring arms 36 to upper plate 32 will become readily apparent to those skilled in the art, given the benefit of this disclosure.

In certain embodiments, spring arms 36 are of unitary construction with lower plate 34, although it is to be appreciated that spring arms 36 could be separate elements individually secured to lower plate 34. In certain embodiments, spring arms 36 are completely curvilinear between lower plate 34 and upper plate 32, that is, no portion of a spring arm 36 is flat or planar along its length between lower plate 34 and upper plate 32.

In certain embodiments, outsole 28 comprises a plurality of outsole elements 44, with an outsole element 44 positioned beneath each spring arm 36.

Cushioning for sole assembly 14 of footwear 10 is provided from the combination of the deflection of spring arms 36 and the deflection of upper plate 32. The thickness, height, and the profile of spring arms 36 can be varied to provide different levels of deflection and support. Additionally, the number and location of spring arms 36 can also be varied to provide support and cushioning in different locations as well as in varied amounts. The material used to form spring arms 36 can also be varied to provide different levels of support and cushioning.

In certain embodiments, four (4) spring arms 36 are positioned about peripheral edge 38 of lower plate 34, with a pair of spring arms 36 positioned on a medial side 16 of lower plate 34 and a pair of spring arms 36 positioned on a lateral side 18 of lower plate 34. As illustrated here, a first spring arm 36 is positioned in a lateral rear portion of heel portion 20 of support assembly 30, a second spring arm 36 is positioned in a lateral forward portion of heel portion 20 of support assembly 30, a third spring arm 36 is positioned in a medial rear portion of heel portion 20 of support assembly 30, and a fourth spring arm 36 is positioned in a medial forward portion of heel portion 20 of support assembly 30.

In the illustrated embodiment, support assembly 30 is positioned in heel portion 20 of sole assembly 14, with an upper surface of upper plate 32 being in contact with and adhesively secured to a lower surface of midsole 26. It is to be appreciated that in other embodiments, support assembly 30 can be positioned elsewhere in sole assembly 14. Thus, for example, support assembly 30 can be positioned in midfoot portion 18, in forefoot portion 16, or it may extend through two or more portions of sole assembly 14. The positioning of support assembly 30 will depend on many factors, and suitable positions will become readily apparent to those skilled in the art, given the benefit of this disclosure.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper; and a sole assembly secured to the upper and including a midsole positioned beneath the upper and a support assembly positioned beneath the midsole, the support assembly comprising:

an upper plate having an upper surface in contact with a lower surface of the midsole, and a plurality of recesses formed in a lower surface of the upper plate;

a lower plate spaced from the upper plate, having a peripheral edge and including a plurality of spring arms, each spring arm having a longitudinal axis curving initially outwardly and upwardly and then inwardly and upwardly, each spring arm extending from the peripheral edge to a lower surface of the upper plate, the spring arms defining a gap between the upper and lower plates within which the spring arms are free to deflect without interference; and a flange member formed at a top end of each spring arm, each flange member being received in a corresponding recess in the upper plate.

2. The article of footwear of claim 1, wherein each spring arm is adhesively secured to the upper plate.

3. The article of footwear of claim 1, wherein each spring arm is completely curvilinear between the lower plate and the upper plate.

4. The article of footwear of claim 1, wherein each flange member is of unitary construction with its corresponding spring arm.

5. The article of footwear of claim 1, wherein each flange member is adhesively secured to the upper plate.

6. The article of footwear of claim 1, wherein the spring arms and the lower plate are of unitary construction.

7. The article of footwear of claim 1, wherein the support assembly includes four spring arms.

8. The article of footwear of claim 7, wherein a first spring arm is positioned in a lateral rear portion of a heel portion of the support assembly, a second spring arm is positioned in a lateral forward portion of the heel portion of the support assembly, a third spring arm is positioned in a medial rear portion of a heel portion of the support assembly, and a fourth spring arm is positioned in a medial forward portion of the heel portion of the support assembly.

9. The article of footwear of claim 1, wherein the upper plate is formed of a polyether-block co-polyamide polymer.

10. The article of footwear of claim 1, wherein the lower plate is formed of nylon.

11. The article of footwear of claim 1, further comprising an outsole secured to a lower surface of the lower plate.

12. The article of footwear of claim 11, wherein the outsole comprises a plurality of outsole elements, an outsole element being positioned beneath each spring arm.

13. The article of footwear of claim 1, wherein the support assembly is positioned in a heel portion of the sole assembly.

14. The article of footwear of claim 1, wherein the upper plate and spring arms of the support assembly are positioned beneath the midsole.

15. The article of footwear of claim 1, wherein the support assembly is positioned beneath a heel portion of the midsole.

16. The article of footwear of claim 1, wherein each spring arm curves outwardly to an extent that an outermost peripheral edge of the spring arm is positioned outwardly of a peripheral edge of the upper plate.

17. An article of footwear comprising, in combination:

an upper; and a sole assembly secured to the upper and including a midsole and a support assembly, the support assembly comprising:

an upper plate including a plurality of recesses in a lower surface thereof;

a lower plate spaced from the upper plate and having a peripheral edge; and a plurality of spring arms of unitary construction with the lower plate, each spring arm having a longitudinal axis curving initially outwardly and upwardly and then inwardly and upwardly, each spring arm extending from the peripheral edge to a lower surface of the upper plate, each spring arm including a flange member at an upper end thereof, each flange member being received in a recess in the upper plate, the spring arms defining a gap between the upper and lower plates within which the spring arms are free to deflect without interference.

18. The article of footwear of claim 17, wherein each spring arm is completely curvilinear between the lower plate and the upper plate.

19. The article of footwear of claim 17, wherein each flange member is of unitary construction with its corresponding spring arm.

20. The article of footwear of claim 17, wherein each flange member is adhesively secured to the upper plate.

21. The article of footwear of claim 17, further comprising an outsole including a plurality of outsole elements, an outsole element being positioned beneath each spring arm.

22. The article of footwear of claim 17, wherein each spring arm curves outwardly to an extent that an outermost peripheral edge of the spring arm is positioned outwardly of a peripheral edge of the upper plate.

23. An article of footwear comprising, in combination:

an upper;

a sole assembly secured to the upper and including a midsole and a support assembly positioned beneath a heel portion of the midsole, the support assembly comprising:

an upper plate including four recesses in a lower surface thereof;

a lower plate spaced from the upper plate and having a peripheral edge; and four spring arms positioned about a peripheral edge of the lower plate and of unitary construction with the lower plate, each spring arm having a longitudinal axis curving initially outwardly and upwardly and then inwardly and upwardly, each spring arm extending from the peripheral edge to a lower surface of the upper plate and being completely curvilinear between the upper plate and the lower plate, each spring arm including a flange member at an upper end thereof, each flange member being received in a recess in the upper plate, the spring arms defining a gap between the upper and lower plates within which the spring arms are free to deflect without interference; and an outsole comprising a plurality of outsole elements, an outsole element being positioned beneath each spring arm.

24. The article of footwear of claim 23, wherein each flange member is of unitary construction with its corresponding spring arm.

25. The article of footwear of claim 23, wherein each flange member is adhesively secured to the upper plate.

26. The article of footwear of claim 23, wherein a first spring arm is positioned in a lateral rear portion of a heel portion of the support assembly, a second spring arm is positioned in a lateral forward portion of the heel portion of the support assembly, a third spring arm is positioned in a medial rear portion of a heel portion of the support assembly, and a fourth spring arm is positioned in a medial forward portion of the heel portion of the support assembly.

27. The article of footwear of claim 23, wherein each spring arm curves outwardly to an extent that an outermost peripheral edge of the spring arm is positioned outwardly of a peripheral edge of the upper plate.

* * * * *